US008615918B2

(12) United States Patent
Shepard, Jr.

(10) Patent No.: US 8,615,918 B2
(45) **Date of Patent: *Dec. 31, 2013**

(54) FIREARM ASSEMBLIES AND METHODS

(71) Applicant: Lone Wolf Distributors, Inc., Oldtown, ID (US)

(72) Inventor: Daniel Rhea Shepard, Jr., Oldtown, ID (US)

(73) Assignee: Lone Wolf Distributors, Inc., Oldtown, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/758,877

(22) Filed: Feb. 4, 2013

(65) Prior Publication Data

US 2013/0139425 A1 Jun. 6, 2013

Related U.S. Application Data

(63) Continuation of application No. 12/687,776, filed on Jan. 14, 2010, now Pat. No. 8,365,456.

(60) Provisional application No. 61/144,587, filed on Jan. 14, 2009.

(51) Int. Cl.
*F41G 1/00* (2006.01)

(52) U.S. Cl.
USPC ..... 42/146; 362/110

(58) Field of Classification Search
USPC ..... 42/84, 111, 113–117, 145–146; 362/110, 113, 114
See application file for complete search history.

(56) References Cited

U.S. PATENT DOCUMENTS

| | | | |
|---|---|---|---|
| 1,432,254 | A | 10/1922 | Paterson et al. |
| 1,615,409 | A | 1/1927 | Selden et al. |
| 4,539,889 | A | 9/1985 | Glock |
| 4,682,435 | A | 7/1987 | Heltzel |
| 4,825,744 | A | 5/1989 | Glock |
| 4,893,546 | A | 1/1990 | Glock |
| 5,179,235 | A | 1/1993 | Toole |
| 5,272,828 | A | 12/1993 | Petrick et al. |
| 5,435,091 | A | 7/1995 | Toole et al. |
| 5,581,898 | A | 12/1996 | Thummel |
| 5,706,600 | A | 1/1998 | Toole et al. |
| 5,867,930 | A | 2/1999 | Kaminski et al. |
| 5,896,691 | A | 4/1999 | Kaminski et al. |
| 6,237,271 | B1 | 5/2001 | Kaminski et al. |
| 6,360,469 | B1 | 3/2002 | Mikuta et al. |
| 6,385,893 | B1 | 5/2002 | Cheng |
| 6,421,944 | B1 | 7/2002 | Klebes et al. |
| 6,430,860 | B1 | 8/2002 | Constant et al. |
| 6,434,875 | B1 | 8/2002 | Constant et al. |
| 6,523,296 | B1 | 2/2003 | Constant et al. |
| 6,526,688 | B1 | 3/2003 | Danielson et al. |
| 6,578,311 | B2 | 6/2003 | Danielson et al. |
| 6,591,536 | B2 | 7/2003 | Houde-Walter et al. |

(Continued)

*Primary Examiner* — Michael David
(74) *Attorney, Agent, or Firm* — Wells St. John P.S.

(57) ABSTRACT

Firearms are provided than can include a firearm frame having a grip attached thereto; a power source recessed within the grip; and a power coupling assembly positioned along the frame, the assembly being in electronic communication with the power source. Firearm frames are provided that can include a grip having a power source therein; and at least one power line extending from the power source to an exterior portion of the frame. Methods of powering a firearm accessory are provided that can include providing a power source within a grip of the firearm; and powering the firearm accessory with the power source.

13 Claims, 4 Drawing Sheets

(56) References Cited

U.S. PATENT DOCUMENTS

| | | | |
|---|---|---|---|
| 6,671,991 | B1 | 1/2004 | Danielson |
| 7,032,342 | B2 | 4/2006 | Pikielny |
| 7,155,855 | B2 | 1/2007 | Mauch et al. |
| 7,260,910 | B2 | 8/2007 | Danielson |
| 7,264,369 | B1 | 9/2007 | Howe |
| 8,365,456 | B1 * | 2/2013 | Shepard, Jr. ..... 42/146 |

* cited by examiner

FIREARM ASSEMBLIES AND METHODS

CROSS REFERENCE TO RELATED APPLICATION

This application is a continuation of U.S. patent application Ser. No. 12/687,776 which was filed on Jan. 14, 2010, entitled "Firearm Assemblies and Methods", which claims priority to U.S. Provisional Patent Application Ser. No. 61/144,587 which was filed on Jan. 14, 2009, entitled "Firearm Assemblies and Methods", the entirety of each of which is incorporated by reference herein.

TECHNICAL FIELD

The present disclosure relates to firearm assemblies and methods, and particularly, power based components for firearms and assemblies.

BACKGROUND

It is becoming more and more common for firearms to utilize components that require electrical power. For example, components have been provided to firearms that drive laser sighted devices as well as lighting devices. The present disclosure provides firearm assemblies and components, embodiments of which provide power to accessories such as laser sighting devices, for example.

SUMMARY

Firearms are provided than can include a firearm frame having a grip attached thereto; a power source recessed within the grip; and a power coupling assembly positioned along the frame, the assembly being in electronic communication with the power source.

Firearm frames are provided that can include a grip having a power source therein; and at least one power line extending from the power source to an exterior portion of the frame.

Methods of powering a firearm accessory are provided that can include providing a power source within a grip of the firearm; and powering the firearm accessory with the power source.

BRIEF DESCRIPTION OF THE DRAWINGS

Preferred embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

Figure 1:
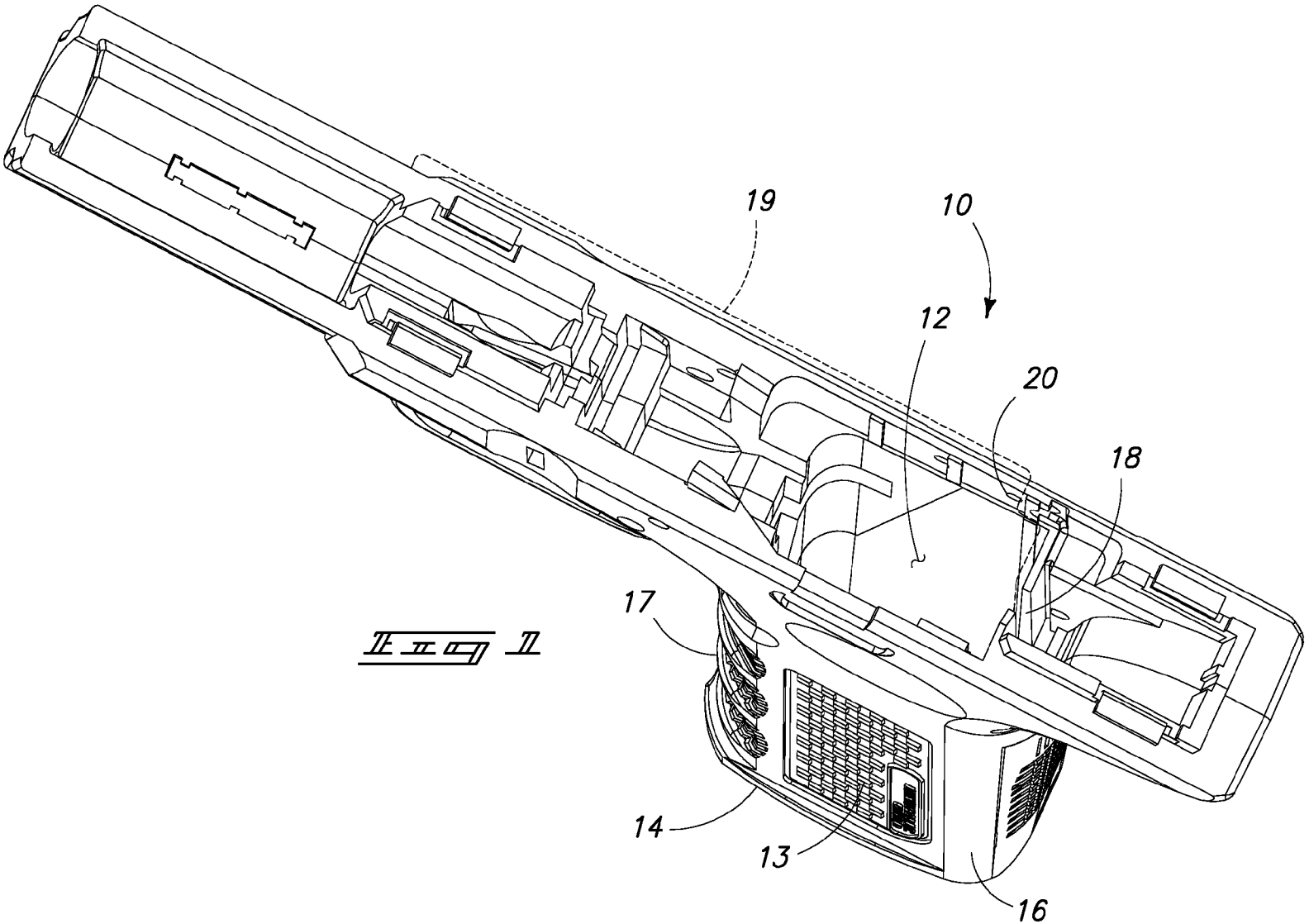
FIG. 1 is an oblique view of a firearm assembly according to an embodiment.

Firearm assemblies and methods are provided with reference to FIGS. 1-8. Referring first to FIG. 1, a firearm frame assembly 10 is show in a perspective view. As an example, frame 10 is configured to engage a slide action having a barrel portion therebetween. A portion of frame 10 can be configured to receive a magazine within magazine chamber 12, and magazine chamber 12 is configured within grip portion 14 which can be attached to frame 10. In accordance with example implementations, frame 10 can be that of a semiautomatic pistol. Frame 10 can define a receiver configured to engage the slide with the receiver extending from grip 14.

According to example implementations, assembly 10 can include cover 16 engaging grip 14 to define an enclosure recessed within grip 14. Cover 16 can have a switch integrated therein, and grip 14 can be configured to couple with cover 16 which is removeably-fixedly engaged with the grip portion.

According to example implementations, cover 16 can enclose a power source that can be electrically coupled through frame 10 to engage accessories that may be coupled to frame 10. According to example implementations, the power source can be coupled via an electrical conduit 19 through opening 18 and then through opening 20 to engage accessories on the exterior of frame 10. Conduit 19 can extend between a power coupling assembly and the power source. Conduit 19 can exit frame 10 and extend along the exterior of frame 10 toward a forward portion of a trigger guard to engage the coupling assembly.

According to an embodiment, the power source may be directly wired to accessories through these openings. According to other embodiments, the power source can be wired to an electrical coupling device proximate and/or extending from opening 20. Accessories may be configured to engage this coupling device when mounted to frame 10. Accessories that may be mounted to the exterior of frame 10 include laser targeting systems and/or lighting systems, for example.

While opening 20 is shown along one side of frame 10, additional openings or other openings can be provided along the opposing side of frame 10. These additional openings can be provided to accommodate shooters that prefer the accessories mounted on specific side or portion of frame 10. Opening 20 can receive a gasket configured to form an airtight seal around conduit 19.

Figure 2:
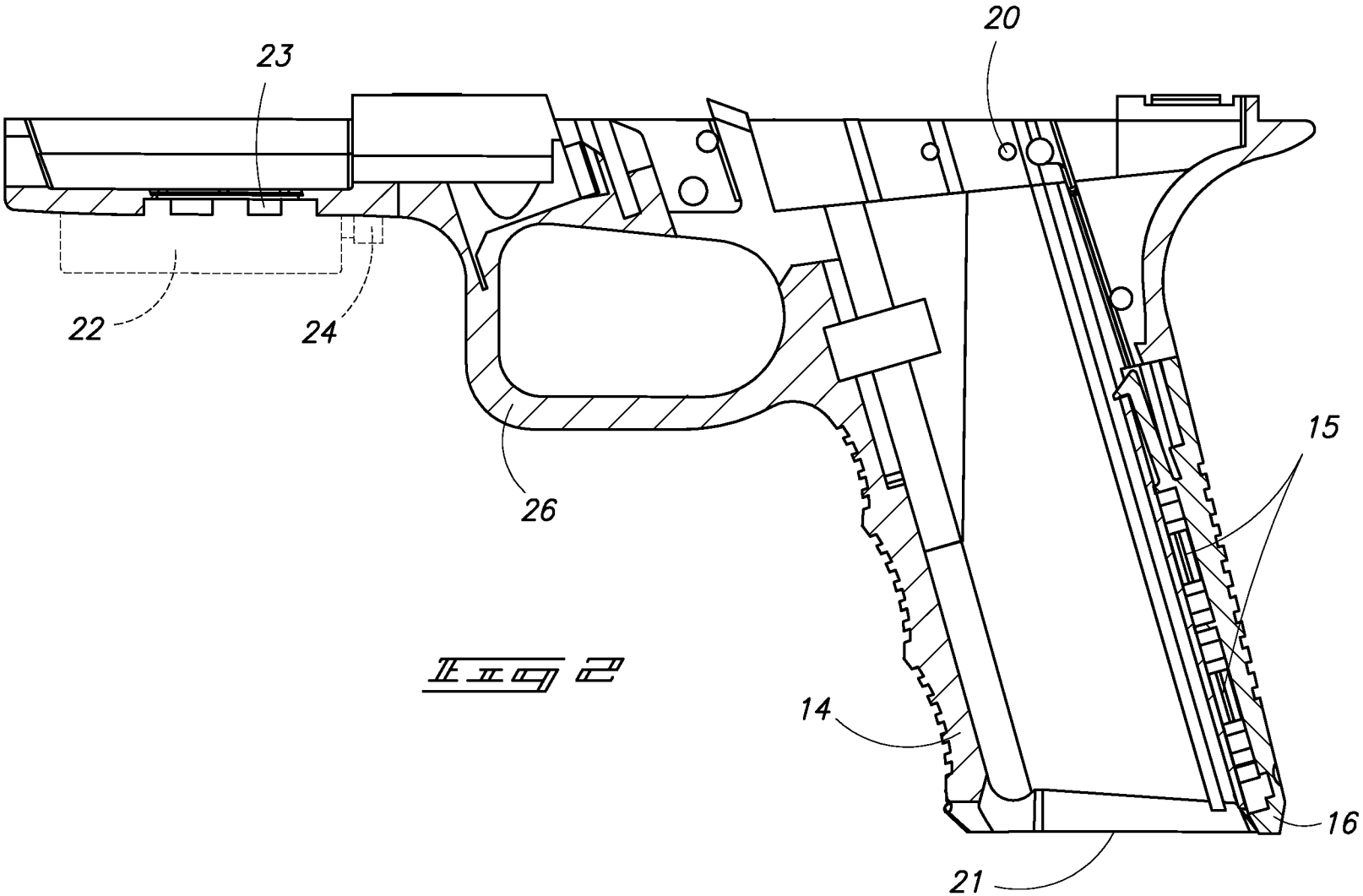
FIG. 2 is a cross-section of the firearm assembly of FIG. 1 according to an embodiment.

Referring to FIG. 2, a cross-section of frame 10 is shown. As shown in this cross-section, opening 20 is configured to receive wire couplings from power source 15 which is recessed within grip 14. The recess of grip 14 can extend along a distal edge of grip 14 from a butt of grip 14. Cover 16 can define at least a portion of the butt of grip 14 when enclosing power source 15.

Figure 4:
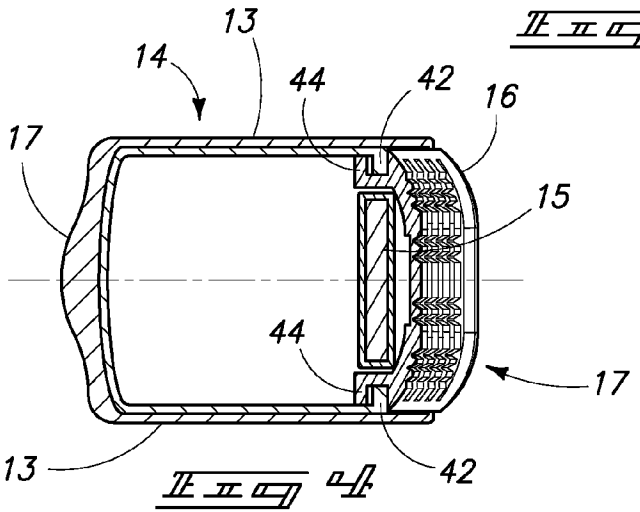
FIG. 4 is a cross-section of a portion of the assembly of FIG. 3 according to an embodiment.
Figures 5, 6, 7, 8:
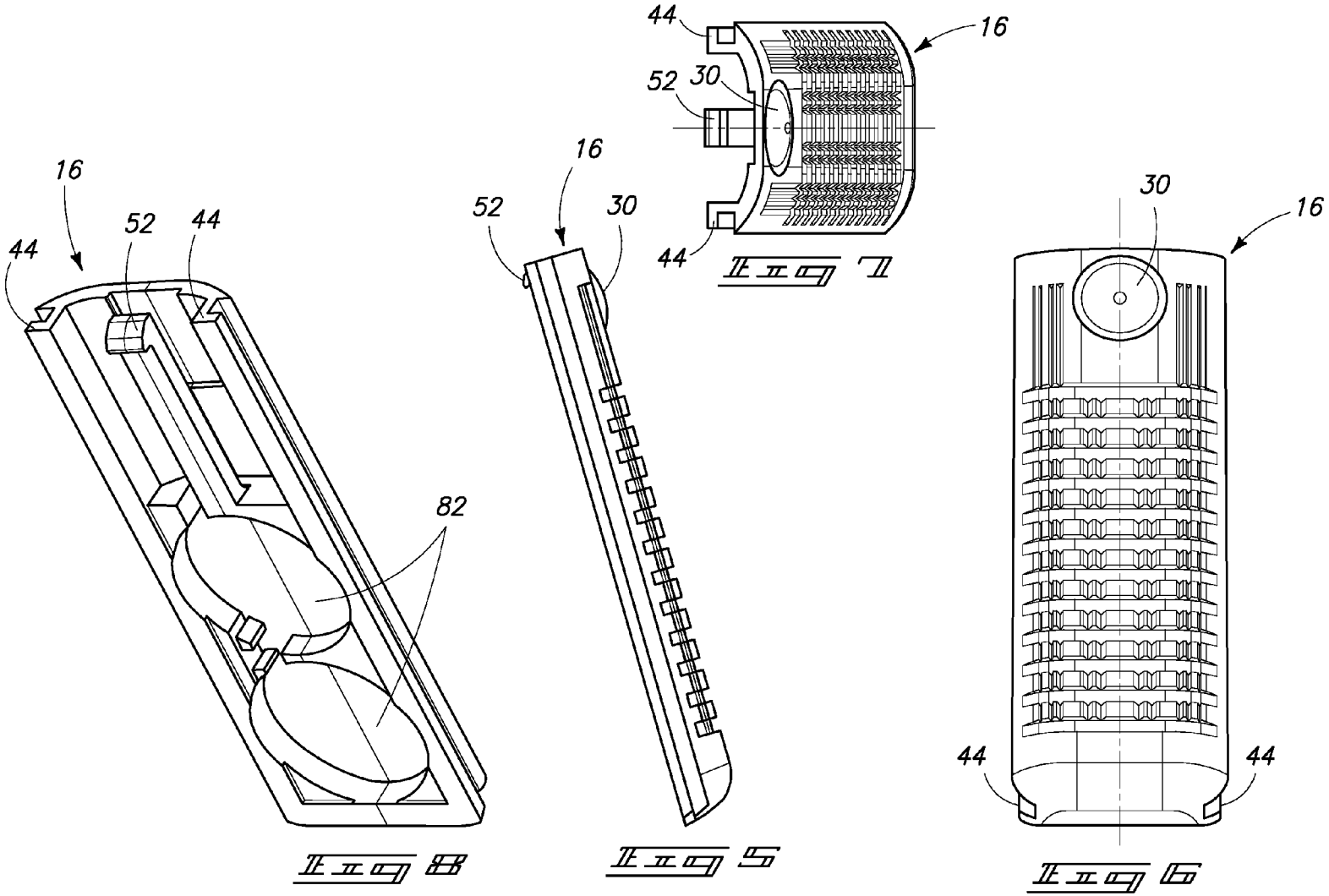
FIGS. 5-8 are views of a component of a firearm assembly according to an embodiment.

Source 15 can be a battery or set of batteries. Example batteries include but are not limited to button cell batteries. Configured as a slide action firearm, the receiver can extend from grip 14. Frame 10 can define trigger guard 26 extending between the receiver and grip 14. Grip 14 can include sides 13 and distal and proximal edges 17 (FIGS. 1 and 4). Sides 13 and edges 17 can extend from a butt 21 and can be associated with guard 26. More particularly, proximal edge 17 can be associated with guard 26, and power source 15 can be recessed within distal edge 17. In a first position, cover 16 can be fully engaged with grip 14 and define an enclosure for source 15. In this first position, cover 16 can retain batteries within grip 14. In a second position, cover 16 can at least partially and/or fully expose the recess of grip 14. According to specific implementations, in the second position, cover 16 can expose one battery while retaining the other. According to other implementations, cover 16 can expose both batteries with still remaining engaged with grip 14.

When engaged with grip 14, cover 16 can complete a continuous edge 17. Such a continuous edge can be consistent with a grip or grips having no power source. Example grip types that can include power source 15 and cover 16 are 1911 style grips.

Figure 3:
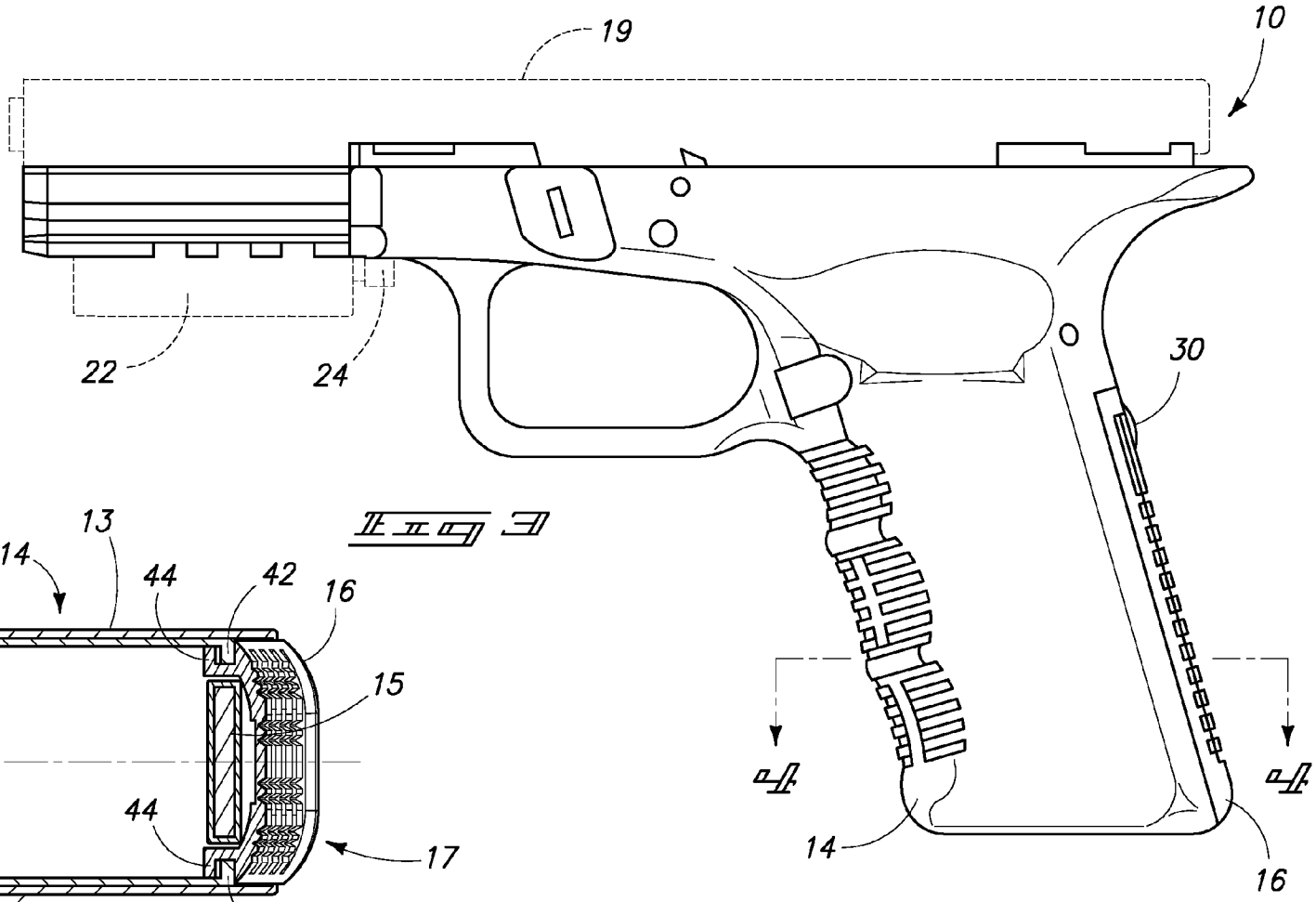
FIG. 3 is a firearm assembly according to an embodiment.

Referring to FIG. 3, a side view of assembly 10 is shown according to an embodiment. According to an example implementation, cover 16 can include switch portion 30. Switch portion 30 can be a single position on/off switch that can take the form of a flexible material encased push button. In one position, switch portion 30 can allow power to be provided to an accessory. In another position, switch portion 30 can prohibit power from being provided from source 15 to an accessory.

Frame 10 can include a power coupling assembly 24 positioned along the frame and/or mounted along frame 10. Coupling assembly 24 can be in electronic communication with source 15, for example. Assembly 24 can be configured as a portion of a connection, such as male or female receptacle. In accordance with example implementations, plug and socket, blade, and/or ring and spade connectors may be utilized. Power coupling assembly 24 can be positioned along the receiver of frame 10. Power coupling assembly 24 may be associated with an accessory mounting assembly 23. Power coupling assembly 24 can be positioned on a portion of ring guard 26 distal of grip 14. Assembly 24 can be located between guard 26 and the receiver.

Accessory mounting assembly 23 can be configured to removeably-fixedly engage an accessory 22. Mounting assembly 23 can be proximate power coupling assembly 24. The proximity of theses assemblies can facilitate both the power coupling and mounting of accessories (22) to frame 10. Assembly 23 can be configured to mate with accessory 22; such assemblies include but are not limited to clips, such as vice clips.

Referring to FIG. 4, and in accord with an example implementation, component 16 can be configured to receive rails 42 of grip portion 14. These rails 42 can be received by flange and post portions 44 of component 16. Rails and/or flange and post portions can be configured to allow cover 16 to slidably engage grip 14.

In accordance with additional implementations, conduit 19 can extend to more than one accessory. Conduit 19 can be severed to provide power to these accessories and/or conduit 19 can extend between the accessories in series. In accordance with additional implementations, frame 10 can be coupled to both a laser sight and a light for example.

Referring to FIGS. 5-8, more detailed views of component 16 are shown. According to example implementations and referring to FIG. 8, component 16 can include recesses 82 configured to receive power sources such as batteries. Component 16 can also include hook and post portion 52 configured to resiliently engage an opening of assembly 10. Portion 52 can be configured to hold component 16 in a fixed position along grip portion 14 to provide a seamless engagement of component 16 as part of grip portion 14. According to example implementations, component 16 can be utilized to provide power to accessories within or along assembly 10 while at the same time providing a complete grip without obstructions or additions.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

The invention claimed is:

1. A firearm comprising:

a firearm frame having a grip attached thereto, the grip defining a forward-most portion associated with a trigger of the firearm and a rearward-most portion distal of the forward-most portion, the grip further defining a channel;

an enclosure cover forming the rearward-most portion and defining an enclosure within the grip of the firearm, the cover further defining one or more recesses configured to receive, a power source, and a coupling member configured to fixedly-couple the cover to the grip and be received by the channel of the grip, wherein the coupling member of the cover is defined by an extension of the cover, the extension being flexibly-biased; and a power coupling assembly positioned along the frame, the power coupling assembly being in electronic communication with the one or more batteries.

2. The firearm of claim 1 wherein the cover further defines a switch.

3. The firearm of claim 1 wherein the cover slidably engages the grip.

4. The firearm of claim 1 wherein the cover forms a portion of the butt of the grip.

5. The firearm of claim 1 further comprising an accessory mounting assembly on the firearm frame, the assembly being proximate the power coupling assembly to facilitate both the power coupling and mounting of accessories.

6. The firearm of claim 1 wherein the power source comprises one or more batteries.

7. The firearm of claim 1 wherein the channel further comprises a recess configured to receive a portion of the extension of the coupling member.

8. A firearm comprising:

a firearm frame having a grip attached thereto, the grip defining a forward-most portion associated with a trigger of the firearm and a rearward-most portion distal of the forward-most portion, the grip further defining a channel;

an enclosure cover forming the rearward-most portion and defining an enclosure within the grip of the firearm, wherein the cover slidably engages the grip, the enclosure and/or cover configured to receive a power source, and a coupling member configured to fixedly-couple the cover to the grip and be received by the channel of the grip, wherein the coupling member of the cover is defined by an extension of the cover, the extension being flexibly-biased; and a power coupling assembly positioned along the frame, the power coupling assembly being in electronic communication with the power source.

9. The firearm of claim 8 wherein the cover further defines a switch.

10. The firearm of claim 8 wherein the cover forms a portion of the butt of the grip.

11. The firearm of claim 8 further comprising an accessory mounting assembly on the firearm frame, the assembly being proximate the power coupling assembly to facilitate both the power coupling and mounting of accessories.

12. The firearm of claim 8 wherein the power source comprises one or more batteries.

13. The firearm of claim 8 wherein the channel further comprises a recess configured to receive a portion of the extension of the coupling member.

* * * * *

UNITED STATES PATENT AND TRADEMARK OFFICE

CERTIFICATE OF CORRECTION

PATENT NO. : 8,615,918 B2
APPLICATION NO. : 13/758877
DATED : December 31, 2013
INVENTOR(S) : Daniel Rhea Shepard, Jr.

It is certified that error appears in the above-identified patent and that said Letters Patent is hereby corrected as shown below:

On the title page

Item (57) Abstract – Replace "provided than can" with --provided that can--

In the specification

Column 1, line 32 – Replace "provided than can" with --provided that can--

Column 1, line 67 – Replace "is show in" with --is shown in--

Column 2, line 38 – Replace "on specific" with --on a specific--

Column 2, line 65 – Replace "with still" with --while still--

Column 3, line 18 – Replace "such as male" with --such as a male--

Column 3, line 30 – Replace "of theses" with --of these--

Column 3, line 35 – Replace "in accord with" with --in accordance with--

Signed and Sealed this
Ninth Day of February, 2016

Michelle K. Lee

Michelle K. Lee
*Director of the United States Patent and Trademark Office*